US008727733B2

(12) United States Patent
Thermos et al.

(10) Patent No.: US 8,727,733 B2
(45) Date of Patent: May 20, 2014

(54) GAS TURBINE COMPRESSOR LAST STAGE ROTOR BLADES WITH AXIAL RETENTION

(75) Inventors: Anthony Constantine Thermos, Greer, SC (US); Govindarajan Rengarajan, Simpsonville, SC (US); William John Miller, Simpsonville, SC (US); Max Robert Farson, Greer, SC (US); Scott Yiming Yu, Greer, SC (US)

(73) Assignee: General Electric Company, Schenectady, NY (US)

( * ) Notice: Subject to any disclaimer, the term of this patent is extended or adjusted under 35 U.S.C. 154(b) by 435 days.

(21) Appl. No.: 13/116,068

(22) Filed: May 26, 2011

(65) Prior Publication Data

US 2012/0301308 A1 Nov. 29, 2012

(51) Int. Cl.
*F01D 5/32* (2006.01)

(52) U.S. Cl.
USPC ..... 416/218; 416/220 R

(58) Field of Classification Search
USPC ..... 416/220 R, 220 A, 221
See application file for complete search history.

(56) References Cited

U.S. PATENT DOCUMENTS 5,518,369 A 5/1996 Modafferi
2009/0252611 A1 * 10/2009 Tipton et al. ..... 416/220 R

FOREIGN PATENT DOCUMENTS

EP 797724 10/1997

OTHER PUBLICATIONS

U.S. Appl. No. 12/078,757, filed Apr. 4, 2008. (Pending).
U.S. Appl. No. 12/007,509, filed Jan. 10, 2008. (Pending).
U.S. Appl. No. 12/689,817, filed Jan. 19, 2010. (Pending).

* cited by examiner

*Primary Examiner* — Dwayne J White
(74) *Attorney, Agent, or Firm* — Nixon & Vanderhye P.C.

(57) ABSTRACT

A rotor blade and blade retention key assembly includes: a radially outer airfoil, a shank and a radially inner attachment dovetail. The attachment dovetail has a radially innermost surface formed with a notch at one axial end thereof, and a retention key is received in the notch, and rotatable from a retracted position where a retention key portion is substantially flush with the radially innermost surface, to an extended position where the retention key portion projects inwardly from said radially innermost surface and into a recess or pocket formed in a rotor wheel slot to prevent axial movement of the blade within the slot.

20 Claims, 3 Drawing Sheets

GAS TURBINE COMPRESSOR LAST STAGE ROTOR BLADES WITH AXIAL RETENTION

BACKGROUND

The present invention relates generally to rotor wheels in turbine engines and specifically to the retention of blades within slots provided in the rotor wheel.

In certain turbine engine configurations, individual blades are loaded into substantially axially-oriented slots or grooves formed in the rotor wheel. The blades must be retained in the slots or grooves so as to prevent any radial or axial movement of the blades during operation of the turbine. Dovetail mountings on the blades and complimentary dovetail slots in the wheel serve to prevent radial movement. There have been devised various techniques for preventing blade movement in the axial direction, some of which involve "staking" of the ends of the blade dovetails after insertion into the complimentary slots. For the rotor wheel or disc in the last stage of certain compressors, however there is little or no access to the front or back of the blade dovetail, rendering the staking method unfeasible.

There remains a need, therefore, for a blade retention mechanism that is easy to install and remove, and that provides effective and reliable blade retention in the axial direction.

BRIEF SUMMARY OF THE INVENTION

Accordingly, in a first exemplary but nonlimiting embodiment, a rotor blade and blade retention key comprising a radially outer airfoil, a shank and a radially inner attachment dovetail; the attachment dovetail having a radially innermost surface formed with a notch at one axial end thereof, a retention key received in the notch and rotatable from a retracted position wherein a retention key portion is substantially flush with the radially innermost surface, to an extended position wherein the retention key portion projects radially substantially inwardly from the radially innermost surface.

In another exemplary but nonlimiting embodiment, the invention provides a rotor wheel fitted with a plurality of rotor blades each rotor blade comprising a radially outer airfoil, a shank and a radially inner attachment dovetail; the attachment dovetail provided with a radially innermost bottom surface formed with a notch at one axial end thereof; retention key received in the notch; and aid rotor wheel formed with plural substantially axially extending slots, each receiving one of the radially inner attachment dovetails; a radially inner surface of one or more of the axially-extending slots formed with a recess; wherein the retention key is rotatable from a retracted position wherein a retention key portion is substantially flush with the radially innermost bottom surface, to an extended position wherein the retention key portion projects radially inwardly from the radially innermost bottom surface and is received in the recess to thereby prevent axial movement of the rotor blade within the slot.

In still another exemplary but nonlimiting aspect, the invention provides a rotor wheel and blade assembly comprising a wheel formed with plural substantially axially extending slots, a radially inner surface of each of the axially-extending slots formed with a recess; plurality of rotor blades each rotor blade comprising a radially outer airfoil, a shank and a radially inner attachment dovetail; the attachment dovetail provided with a radially innermost bottom surface formed with a notch at one axial end thereof; a retention key received in the notch, the retention key having a transversely-oriented, part-cylindrical key portion and a substantially axially-extending actuation portion; each of the plural substantially axially extending slots receiving one of the radially inner attachment dovetails; and wherein the retention key is rotatable from a retracted position wherein the transversely-oriented, part-cylindrical key portion is substantially flush with the bottom surface, to an extended position wherein the transversely-oriented, part-cylindrical key portion projects into the recess to thereby prevent axial movement of the rotor blade within the slot.

The invention will now be described in detail in connection with the drawings identified below,

DETAILED DESCRIPTION OF THE INVENTION

Figure 1:
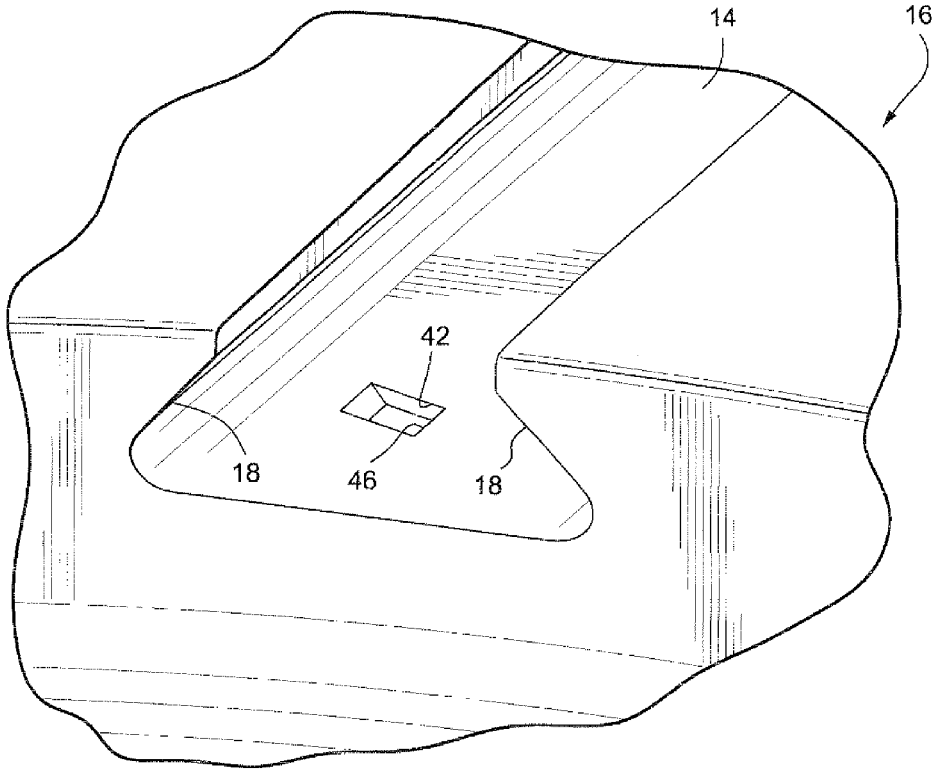
FIG. 1 is a partial perspective view of a rotor wheel dovetail slot formed with a key-receiving recess in accordance with an exemplary but nonlimiting embodiment of the invention.
Figure 2:
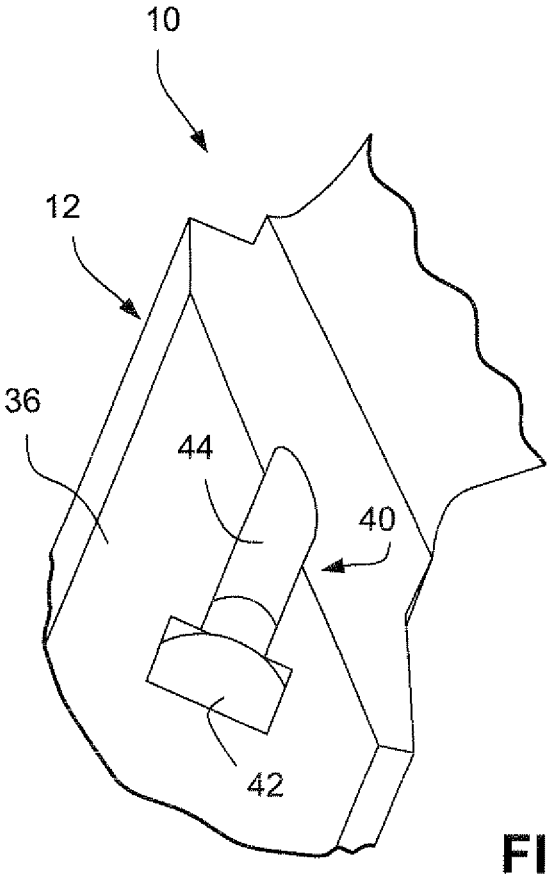
FIG. 2 is a partial perspective view of a radially inner surface of a bucket dovetail formed with a groove for mounting a retention key in accordance with the exemplary but nonlimiting embodiment of the invention.

For certain well-known turbine compressor rotor constructions, a plurality of blades or buckets are loaded into generally axially-oriented slots or grooves in the axially-spaced rotor wheels. With reference initially to FIGS. 1 and 2, the individual blades or buckets 10 typically include a radially outer airfoil portion (not shown), a shank portion (not shown) and a radially inner dovetail mounting portion 12. The dovetail mounting portion 12 (or simply, "dovetail") is slidably received in the slot or groove 14 formed in the rotor wheel 16. The slot or groove 14 is formed with sidewalls 18 complimentary to the dovetail 12 such that the bucket is fixed against any radial movement within the slot once the blade or bucket 10 is installed in its respective wheel slot or groove 14. It is also important, however, to prevent any axial movement of the bucket within the slot.

Figure 3:
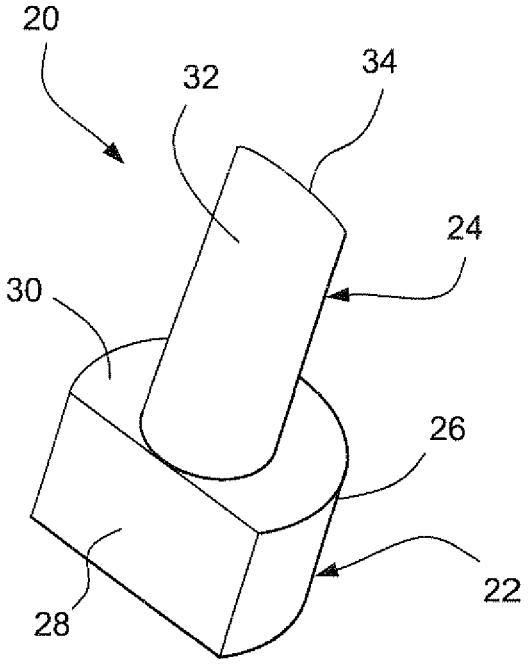
FIG. 3 is a perspective view of a retention key for use with the bucket dovetail shown in FIG. 2.

Accordingly, a rotatable axial retention key 20 as shown in FIG. 3, is provided that is formed to include an axial retention key portion 22 and an actuation portion 24 extending therefrom. More specifically, the retention key portion 22 is formed in a substantially truncated cylindrical shape with a circumferential surface 26 subtending an arc of approximately 220°, and terminating at opposite ends of a flat surface 28. The key actuating portion 24 extends substantially perpendicularly from a flat edge 30 of the retention key portion 22 and is in the form of a solid shaft 32 terminating at a flat, angled end face 34. As will be described further herein, the end face 34 may be provided one or more slots 38, described further below, for receiving a corresponding edge(s) of an actuation tool when it is desired to rotate the retention key 20.

As best seen in FIG. 2, one end of the radially innermost surface 36 of the dovetail 12 of the bucket 10 is partially shown and is formed with a substantially axially extending, compound notch 40 that includes a relatively larger diametrical recess 42 that opens to a relatively smaller diametrical recess 44 designed to receive the retention key 20. Specifically, the notch 40 is sized such that the larger recess 42 is shaped to receive the retention key portion 26 and the smaller recess 44 is shaped to receive the actuation portion 24.

Figure 4:
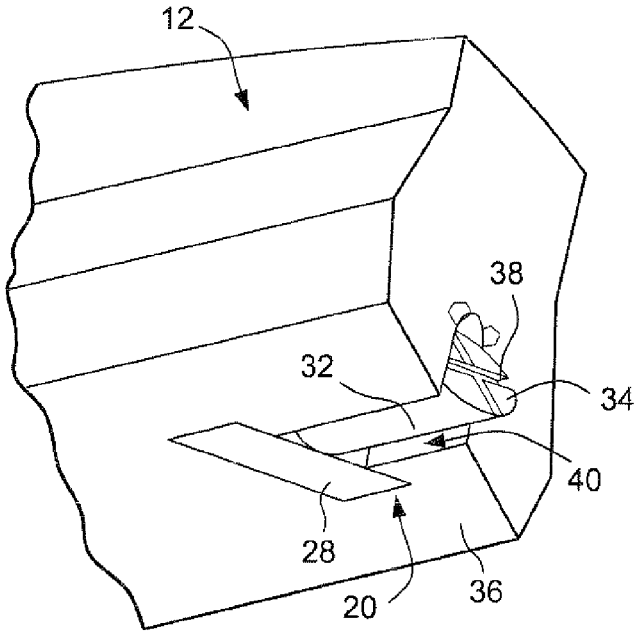
FIG. 4 is a partial perspective view showing the retention key of FIG. 3 installed within the bucket dovetail shown in FIG. 2 in a retracted position.
Figure 5:
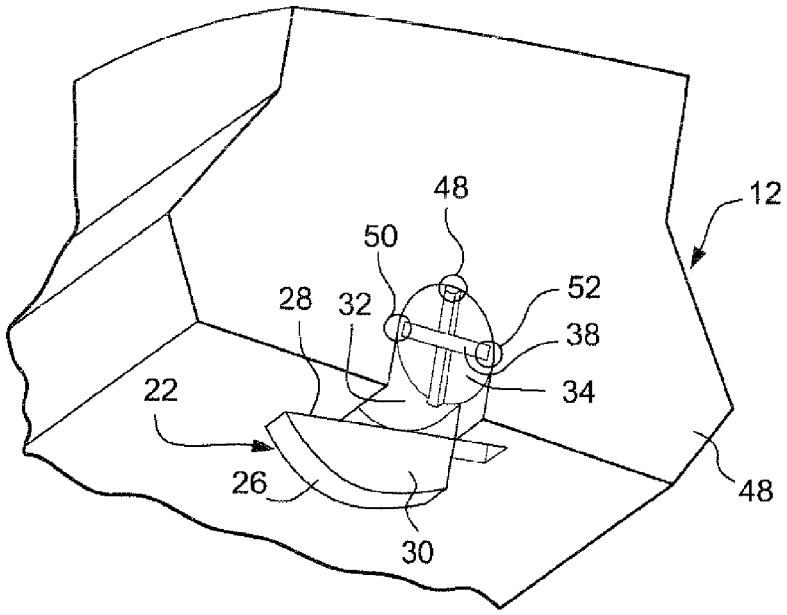
FIG. 5 is a partial perspective view similar to FIG. 4 but showing the retention key rotated to an extended position.

The retention key 20 fits within the notch 40 as best seen in FIG. 4 where the retention key 20 is shown in a retracted position, with the flat surface 28 substantially flush with the radially innermost surface 36 of the dovetail 12. Note also that the actuation portion 24 is at all times flush with or radially recessed from surface 36. As also shown in FIG. 4, the angled end face 34 of the shaft 32 is formed with a tool-engagement surface feature which, in the example embodiment, includes a pair of intersecting slots (or a cross slot) 38, so that a Phillips-head screwdriver may be employed to rotate the retention key 20 from the retracted position shown in FIG. 4 to the extended position shown in FIG. 5. The shape of the tool receiving slot or slots may vary depending on the tool to be used to rotate the retention key. In FIG. 5, the retention key 20 is shown rotated 90° in a counterclockwise direction relative to its orientation in FIG. 4. A portion of the retention key portion 22 moves into a recess or pocket 42 formed in the bottom surface of the wheel slot in which the dovetail 26 is received.

With reference again to FIG. 1, the recess or pocket 42 formed in the flat, substantially axially-extending surface 44 of the wheel slot 14 may have a shape generally similar to the exposed portion of the retention key portion 22 shown in FIG. 4, with a limit surface 46 on one side of the recess that, for example, allows rotation of the retention key 20 only about 90° in the counterclockwise direction. By so limiting the rotation, it is communicated to the user that the retention key 20 has been rotated to its finally-extended position. Further in this regard, it will be appreciated that the dimensions of the pocket or recess 42 are critical only in the axial direction, but not in the transverse direction. In other words, the key portion 22 must fit within the recess or pocket 42 with close axial tolerances to substantially eliminate any axial movement of the dovetail 26 within the wheel slot 14. The dimensions of the pocket or recess in the transverse direction are not particularly critical except in the case where a limit surface, such as surface 46, is provided to limit the extent of the rotation of the retention key 20.

It is also noted that the flat end face 34 of the key actuating portion or shaft 22 is angled so that when the axial retention key 20 is in the extended position, the end face 34 will be substantially flush with the end surface 48 of the dovetail 12. Note that this is not the case when the axial retention key 20 is shown in the retracted position (FIG. 3). This is because the end surface 48 of the dovetail 12 is not square to the rotor wheel. In other words, the wheel slots 12 in which the blades are received extend at an acute angle in the axial direction relative to the rotor shaft, so that the blades are properly oriented relative to the incoming flow across the blades.

It is also to be noted that no separate means need be provided to hold the retention key 20 in the notch 40 prior to installation. The retention key and blade or airfoil are loaded manually into the wheel slot or groove 12, and the retention key 20 may be held in place while the airfoil is loaded into the slot or groove. After installation, the end face 34 may be staked as shown at 48, 50 to prevent rotation of the key to the retracted portion.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotor blade and blade retention key comprising:

a radially outer airfoil, a shank and a radially inner attachment dovetail; said attachment dovetail having a radially innermost surface formed with a notch at one axial end thereof, a retention key received in said notch and rotatable from a retracted position wherein a retention key portion is substantially flush with said radially innermost surface, to an extended position wherein said retention key portion projects radially substantially inwardly from said radially innermost surface.

2. The rotor blade and blade retention key of claim 1 wherein said retention key includes an axially extending shaft portion integral with said retention key portion that remains inset from, or substantially flush with, said radially innermost surface during rotation of said retention key from said retracted position to said extended position.

3. The rotor blade and blade retention key of claim 2 wherein said axially extending shaft portion has an end face substantially flush with a side surface of said attachment dovetail when said retention key is in said extended position, said end face having a tool-engagement surface feature enabling rotation of said retention key between said retracted position and said extended position.

4. The rotor blade and blade retention key of claim 2 wherein said retention key portion is substantially perpendicular to said axially-extending shaft portion.

5. The rotor blade and blade retention key of claim 3 wherein said tool-engagement surface feature is a cross slot.

6. The rotor blade and blade retention key of claim 1 wherein said retention key portion has a truncated cylinder-shape including a flat surface that is substantially flush with said radially innermost surface with said retention key is in said retracted position.

7. The rotor blade and blade retention key of claim 3 wherein said notch includes a first transverse notch area for receiving said retention key portion, and an axial notch area for receiving said axially extending shaft portion.

8. The rotor blade and blade retention key of claim 1 wherein rotation from said retracted position to said extended position subtends an arc of about ninety degrees.

9. The rotor blade and blade retention key of claim 6 wherein said retention key portion has an arcuate surface extending about 220° connected at opposite ends to said flat surface.

10. A rotor wheel fitted with a plurality of rotor blades each rotor blade comprising a radially outer airfoil, a shank and a radially inner attachment dovetail; said attachment dovetail provided with a radially innermost bottom surface formed with a notch at one axial end thereof;

a retention key received in said notch; and said rotor wheel formed with plural substantially axially extending slots, each receiving one of said radially inner attachment dovetails; a radially inner surface of one or more of said axially-extending slots formed with a recess; wherein said retention key is rotatable from a retracted position wherein a retention key portion is substantially flush with said radially innermost bottom surface, to an extended position wherein said retention key portion projects radially inwardly from said radially innermost bottom surface and is received in said recess to thereby prevent axial movement of said rotor blade within said slot.

11. The rotor wheel of claim 10 wherein said retention key includes an axially extending shaft portion integral with said retention key portion that remains inset from, or substantially flush with, said radially innermost surface during rotation of said retention key from said retracted position to said extended position.

12. The rotor wheel of claim 11 wherein said axially extending shaft portion has an end face substantially flush with a side surface of said attachment dovetail when said retention key is in said extended position, said end face having a tool-engagement surface feature enabling rotation of said retention key between said retracted position and said extended position.

13. The rotor wheel of claim 11 wherein said retention key portion is substantially perpendicular to said axially-extending shaft portion.

14. The rotor wheel of claim 12 wherein said tool-engagement surface feature is a cross slot.

15. The rotor wheel of claim 10 wherein said retention key portion has an arcuate surface connected at opposite ends to a flat surface, said flat surface substantially flush with said radially innermost surface when said retention key is in said retracted position.

16. The rotor wheel of claim 11 wherein said notch includes a first transverse notch area for receiving said retention key portion, and an axial notch area for receiving said axially extending shaft portion.

17. The rotor wheel of claim 10 wherein rotation from said retracted position to said extended position subtends an arc of about ninety degrees.

18. The rotor wheel of claim 15 wherein said arcuate surface extends about 220°.

19. The rotor wheel of claim 10 wherein said recess has a limit surface engageable by said flat surface when said retention key is rotated to said extended position.

20. A rotor wheel and blade assembly comprising:

a wheel formed with plural substantially axially extending slots, a radially inner surface of each of said axially-extending slots formed with a recess;

a plurality of rotor blades each rotor blade comprising a radially outer airfoil, a shank and a radially inner attachment dovetail; said attachment dovetail provided with a radially innermost bottom surface formed with a notch at one axial end thereof;

a retention key received in said notch, said retention key having a transversely-oriented, part-cylindrical key portion and a substantially axially-extending actuation portion;

each of said plural substantially axially extending slots receiving one of said radially inner attachment dovetails; and wherein said retention key is rotatable from a retracted position wherein said transversely-oriented, part-cylindrical key portion is substantially flush with said bottom surface, to an extended position wherein said transversely-oriented, part-cylindrical key portion projects into said recess to thereby prevent axial movement of said rotor blade within said slot.

* * * * *